169-45 SR
8/23/77 OR 4,043,397

Not out These

United States Patent [19]

Glowienke

[11] 4,043,397

[45] Aug. 23, 1977

[54] FIRE FIGHTING EQUIPMENT

[76] Inventor: Richard A. Glowienke, Rte. No. 1, Box 720, Necedah, Wis. 54646

[21] Appl. No.: 615,523

[22] Filed: Sept. 22, 1975

[51] Int. Cl.[2] ..... A62C 1/00; A62C 31/00; B05B 1/14

[52] U.S. Cl. ..... 169/45; 169/46; 169/48; 239/280; 239/532; 239/552; 239/553.5; 239/592

[58] Field of Search ..... 169/43, 45–47, 169/48, 5; 239/280–281, 450, 461, 498, 502, 518, 552, 553.5, 590.5, 592, 594, 595, 600, 532, 587, 286, 287, 589; 222/174

[56] References Cited

U.S. PATENT DOCUMENTS

| | | | |
|---|---|---|---|
| 646,072 | 3/1900 | Hart | 239/590.5 X |
| 1,557,477 | 10/1925 | Klinkhammer | 239/532 |
| 2,501,639 | 3/1950 | Warren | 239/587 X |
| 2,609,240 | 9/1952 | Faulkner et al. | 239/553.5 X |
| 2,684,690 | 7/1954 | Lee | 239/590.5 X |
| 2,910,711 | 11/1959 | Mizelle | 239/532 UX |
| 3,041,748 | 7/1962 | Wetzel | 239/592 |
| 3,069,100 | 12/1962 | Schuler | 169/48 X |
| 3,206,126 | 9/1965 | Thompson | 239/281 |

FOREIGN PATENT DOCUMENTS

| | | | |
|---|---|---|---|
| 960,452 | 4/1950 | France | 169/5 |
| 652,781 | 2/1963 | Italy | 239/281 |
| 657,797 | 11/1963 | Italy | 239/532 |
| 69,433 | 7/1945 | Norway | 239/280.5 |
| 77 | 1888 | United Kingdom | 169/48 |

*Primary Examiner*—Evon C. Blunk
*Assistant Examiner*—Andres Kashnikow
*Attorney, Agent, or Firm*—Elmer L. Zwickel

[57] ABSTRACT

Fire fighting equipment consisting of a water flow pipe, connected at one end to a pressurized water source, and having an 180° bend at its other end which carries a novelly constructed spray nozzle and having anti-swirl elements in the flow passages. The method of use is also disclosed.

4 Claims, 9 Drawing Figures

36
32
32
34
31
16
14

36
33
35
32
29
34a
34
31
28
16
16
38
37
14
13
11

14
16
11

FIRE FIGHTING EQUIPMENT

The invention relates to improvements in fire fighting equipment and is particularly concerned with the method of, and means for preventing flames billowing out of a window opening on one floor level of a building and, by or through "looping", up the outer face of the building and into a window opening in the floor directly above. The invention is especially useful to contain and subdue a blaze in a high rise primarily because conventional fire fighting equipment cannot reach upper floors. The present practice of sending firemen to the fire floor level is extremely hazardous because of heated gases, smoke and live flame contained in the area. The equipment herein disclosed avoids this endangering of lives and is extremely effective in its prevention of "looping".

"Looping" may be described as flames that billow out of a window opening on one floor level and which are carried by draft and heat upwardly over the face of the building and into a window opening on the floor level above the level containing the blaze and thereby causing spread of the fire on that level. The disclosed structure is also useful to direct water or foam from a lower floor level to a point above or through a window or other opening on the next higher floor level directly against flames contained on the higher floor level.

More specifically, the equipment includes a pipe of requisite length that is connected at one end to a water line or hose and which has its other end looped back upon itself approximately 180° . The bent end carries a novelly constructed nozzle designed to generate a fan-shaped wall of water useful to contain the billowing flames and prevent them from "looping" and entering the floor level directly above.

The 180° reverse bend in the pipe causes the pressure of the water flow of from 80 to 100 Lbs. P.S.I., tip pressure, to neutralize the pressure in the pipe thus making it possible for one man to hold the equipment whereas, without such bend, the tip pressure would necessitate the services of several men to handle the equipment. Pressurized water or foam flowing through a pipe tends to spiral, consequently the herein disclosed equipment includes means to prevent such spiraling so as to insure that the water spray passing out of the nozzle is flat and solid.

It is therefore an object of the invention to provide a new method for preventing "looping" of flames.

Another object is to provide novel equipment to prevent "looping" of flames.

Another object is to provide a water pipe having a spray nozzle on one end with a 180° bend adjacent to said nozzle that is effective in aiding to neutralize the pressure of the water flow therein.

Another object is to provide a blanket of water or foam directly over a blaze on a flat surface.

Another object is to provide apparatus of the character referred to with a novelly constructed nozzle.

Another object is to provide a pipe and nozzle through which highly pressurized water flows with means to prevent swirling of the water flowing therethrough.

Another object is to provide equipment of the character described which is not expensive to construct or maintain serviceable, and which is not difficult to handle and is very effective in use.

Other objects and advantages of the invention will become apparent with reference to the following description and accompanying drawings.

IN THE DRAWINGS

Figure 3:
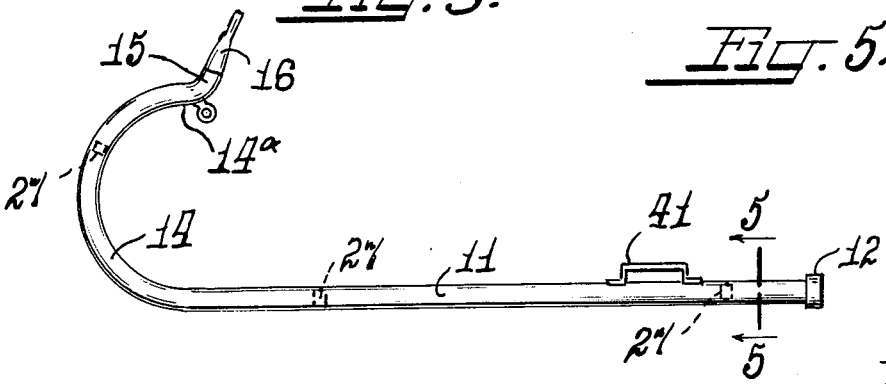
FIG. 3 is an elevational view of the water pipe with the spray nozzle attached.

Referring to the exemplary disclosure of the fire fighting equipment illustrated in the accompanying drawings, the equipment includes a pipe 11 (FIG. 3) of sufficient diameter (about 1½ in. I.D.) to permit the free flow of water or foam under a tip pressure of from 80 to 100 Lbs, p.s.i. This pipe has a conventional fitting 12 at one end for attaching to a hose line 13 leading from a source of pressurized water. The other end portion 14 of the pipe is bent or otherwise formed with an 180° bend, which bend terminates in a 70° bend, as at 15, and has a spray nozzle 16 firmly secured thereto in any suitable manner, such as by welding.

The bend 14 in the pipe has the purpose of equalizing the pressure within the pipe. For example, the 80 to 100 Lbs, tip pressure in a pipe normally creates back pressure of several hundred pounds. This back pressure is neutralized or balanced by an equal pressure developed in the reverse portion 14a of the bend. As a consequence, one man can hold and control this equipment while it is in use whereas, were such bend not present three and perhaps more men would be required to stabilize the equipment to overcome the pressure of the flow of water therein.

Figure 6:
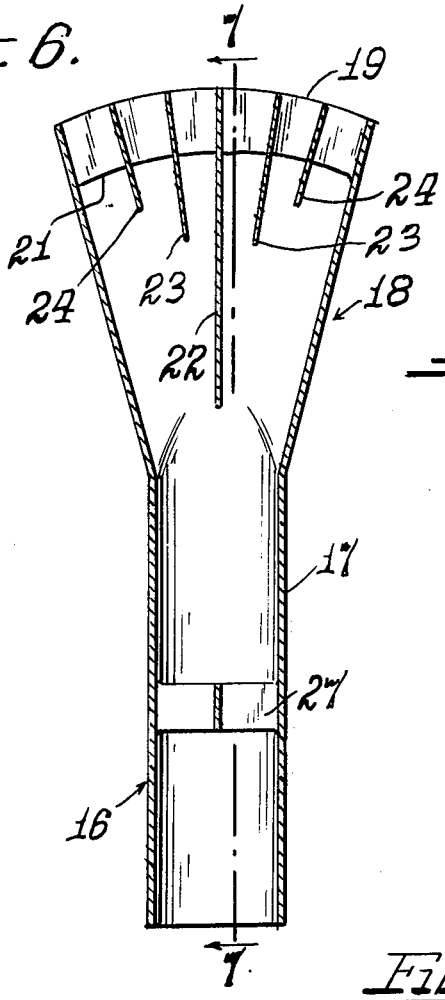
FIG. 6 is a sectional plane view of the spray nozzle.
Figure 7:
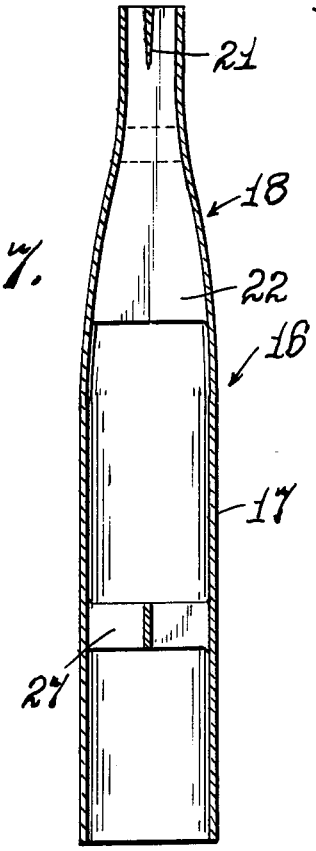
FIG. 7 is a transverse section of the nozzle taken along line 7—7 of FIG. 6.
Figure 8:
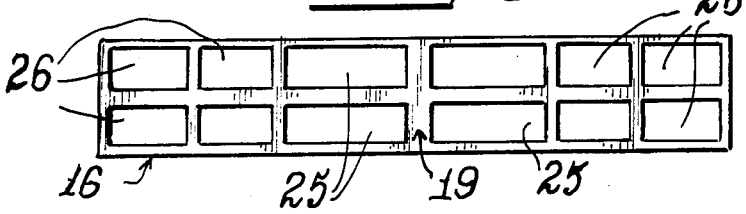
FIG. 8 is an enlarged elevational view of the discharge end of the nozzle.

The spray nozzle 16 (FIGS. 6, 7 and 8), which has its tubular body 17 secured firmly to portion 15 of pipe 11, has its forward or discharge end 18 flattened in one direction (FIG. 7) and widened in the other direction (FIG. 6). The nose 19 of the nozzle is arched outwardly toward its center and it is formed with a honey-combed discharge, as best shown in FIG. 8. This honey-comb is developed by forming an integral web 21 parallel with the flat sides and has a centrally located partition wall 22 of considerable length dividing the discharge into two like halves. Each half has partition walls 23, 24 spaced one from the other end from wall 22; the walls 23 being shorter than the central partition 22 and the walls 24 being shorter than walls 23. It should be noted that the combined area of the discharge openings 25, 26, is equal to or slightly greater than the cross sectional area of the body 17 to assist an anti-swirl element (discussed hereinafter) and the pipe bend 14 in eliminating back pressure, and that the openings 25 are longer than openings 26.

Figure 5:
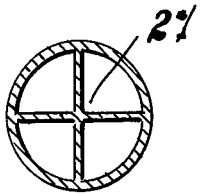
FIG. 5 is a sectional detail of the pipe taken substantially on Line 5—5 of FIG. 3, showing the anti-swirl baffle therein.

It is well known that pressurized water tends to swirl while flowing through a conduit consequently the pipe 11 and the nozzle 16 are each provided with one or more anti-swirl cross-type baffles 27 (FIG. 5).

Figure 2:
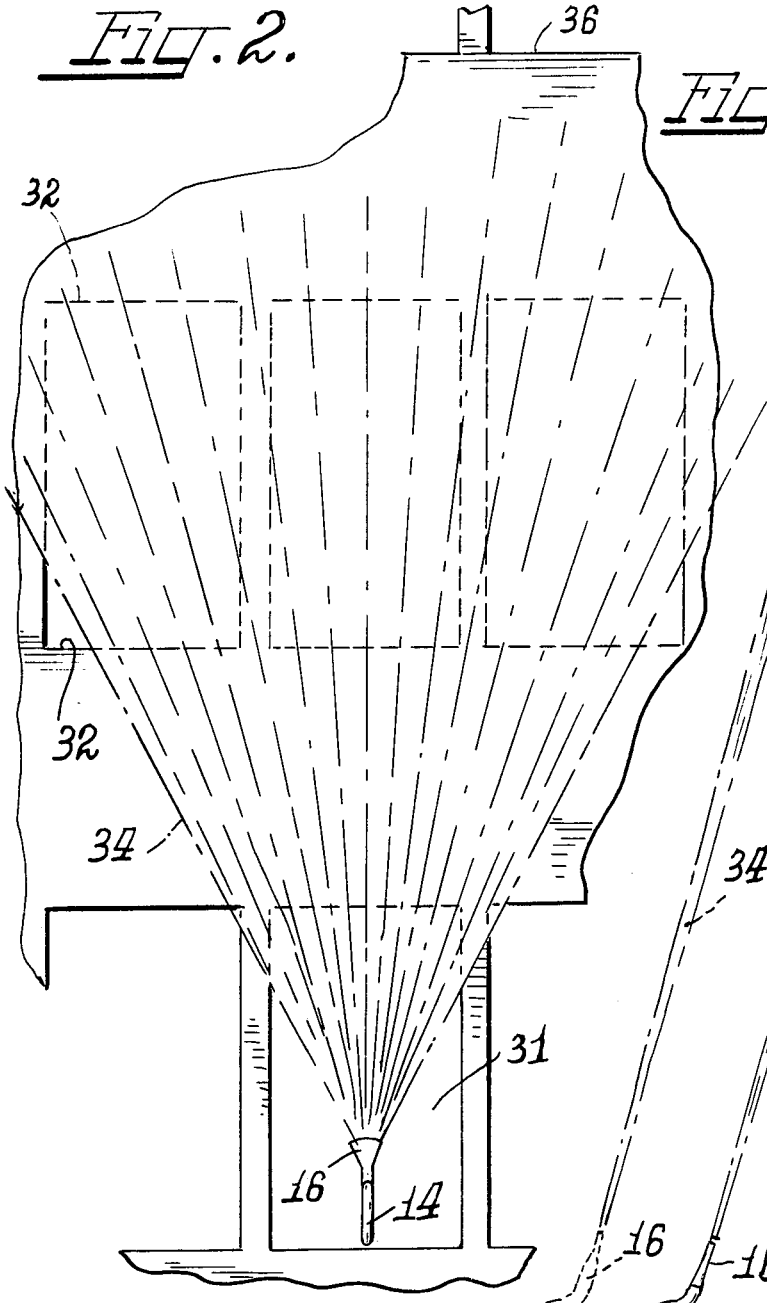
FIG. 2 is a fragmentary elevational view of the building showing the equipment in place therein and illustrating the area enveloped by the spray.
Figure 1:
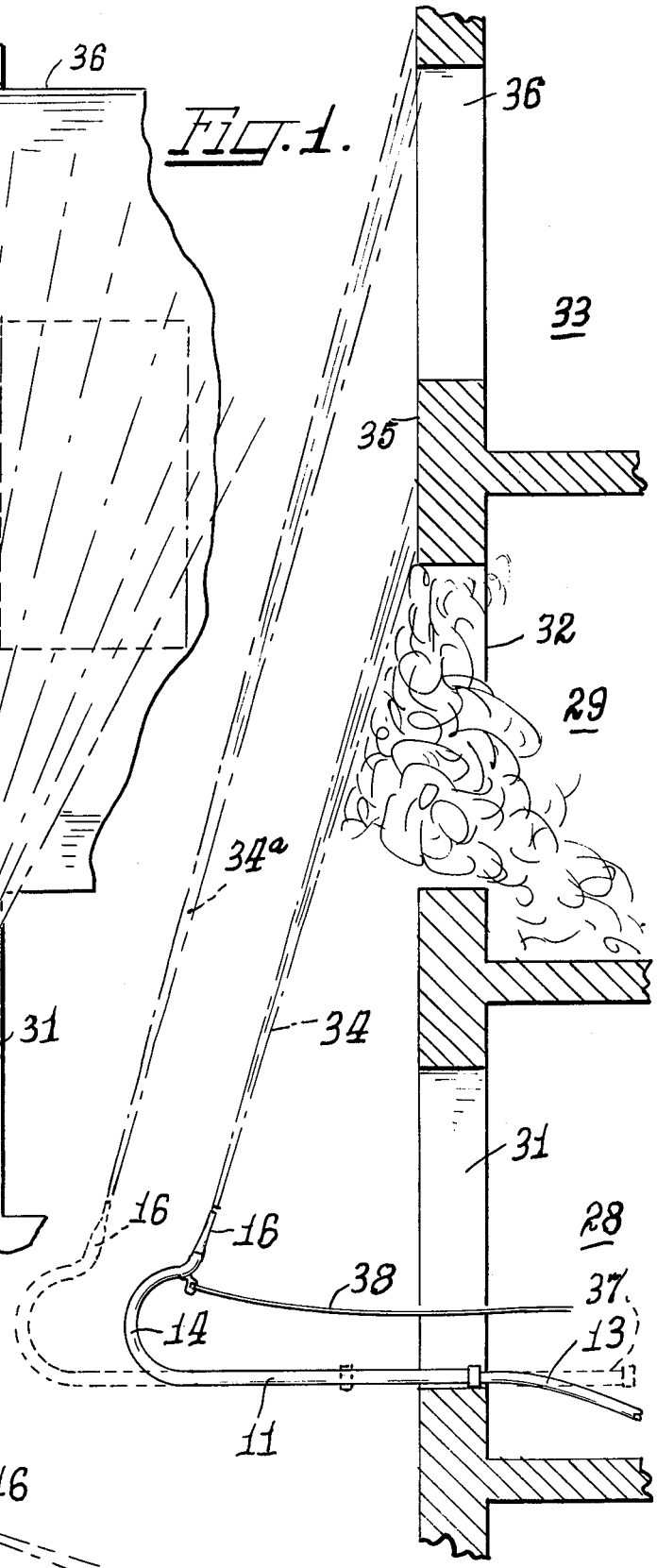
FIG. 1 is a representative sectional view of a portion of a building showing the improved equipment in positions of use therein, and illustrating the spray pattern.

In use, the pipe 11, with hose line 13 and nozzle 16 in place, is taken to a floor level 28 (FIG. 1) one floor below the floor level 29 on which the fire is located and is extended out through the window opening 31, preferably being seated on the window ledge. Because of usual "looping" of flames billowing from window opening 32, the floor level 33 above the fire level can and usually does become engulfed in fire. To avoid this, the nozzle 16 is directed in an upward direction (full lines in FIG. 1) so as to discharge its spray 34 onto the wall area 35 immediately above the billowing flames. Because the nozzle discharges a relatively wide unbroken wall of water in advance of the billowing flames, the tendency for the flames to "loop" is defeated and the fire is contained on the original floor level.

Figure 4:
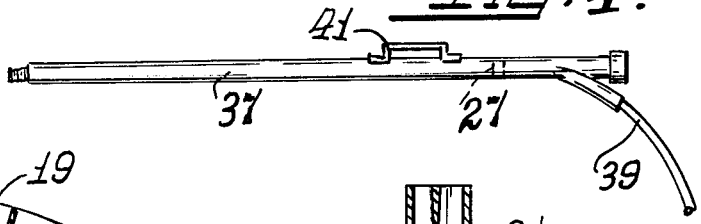
FIG. 4 is an elevational view of a pipe extension.

In some instances it may be advantageous to extend the wall of water to a higher level, such as the window opening 36 on floor level 33 or onto the building face above the floor level 33. To accomplish this readily, a pipe extension 37 (FIG. 4) may be attached to pipe 11 so that the nozzle can be located further from the building (dotted lines, FIG. 1) and will therefore deliver its wall of water 34*a* to the higher level. The sole person handling this equipment may be assisted in balancing the load by means of a cable 38 attached to the bend as shown. Also, should foam be required, such foam may be syphoned from a suitable source into the water flow by means of an auxiliary line 39 illustrated in FIG. 4. Both the pipe 11 and extension 37 may have assist handles 41 thereon.

Figure 9:
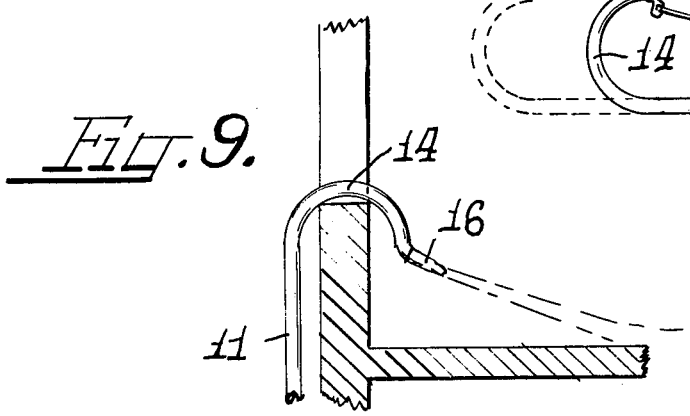
FIG. 9 is a schematic view showing another disposition or use of the equipment.

It might also be noted that the nozzle 16 can be attached to a straight pipe (37) for use as a monitor pipe. This creates a water or foam blanket for discharge onto the top of a blaze on a given horizontal surface. Further, the bend 14 in pipe 11 can function as a hook to be hung over a window ledge (FIG. 9) on the fire floor level for discharging a blanket of water or foam directly on burning contents on said floor, thus extinguishing the blaze and eliminating the hazards of heated gases, smoke and live flames encountered by a fireman were he to enter the burning premises.

Although I have described a preferred embodiment of my invention, in considerable detail, it will be understood that the description thereof is intended to be illustrative rather than restrictive, as details of the structure and the steps of the method may be modified or changed without departing from the spirit or scope of the invention. Accordingly, I do not desire to be restricted to the exact method and construction shown and described.

I claim:

1. The method of preventing looping of billowing flames on a floor level of a building structure, locating a fluid flow pipe having a reverse bend of 180° at its discharge end on a floor level below said first mentioned floor level, connecting the other end of said pipe to a source of pressurized water, connecting a spray nozzle to the bent end of said pipe and at an angle thereto, extending the pipe through a wall opening to locate the nozzle outside the building structure, and discharging a substantially solid wall of water in the form of a spray from said nozzle without back pressure onto the building structure above the first mentioned floor level so as to overlie and contain the billowing flames and prevent their looping.

2. Hand-held equipment for use in fighting fire in a high-rise building comprising, a length of rigid pipe through which pressurized non-flamable fluid is to be flowed, a hose connection at the inlet end of said pipe, a 180° bend adjacent to the outlet end of said pipe to equalize the effect of pressure in the pipe, and a bend of about 70° relative to the axis of the pipe at the discharge end of the 180° bend, said 70° bend lying in the same plane as the 180° bend, a spray nozzle, said nozzle having a fan-shaped discharge end including flat sides and a tubular inlet end, said inlet end being connected to the bent pipe end, a partition in said discharge end of said nozzle midway between and parallel to the nozzle flat sides, and a plurality of webs in said discharge end disposed at right angles to and on both sides of the partition which together with the partition divide the discharge end into two rows of discharge orifices.

3. The equipment recited in claim 2, wherein the webs are of different selected lengths and have their outer ends in substantial register.

4. The equipment recited in claim 2, wherein the spray nozzle has an anti-swirl baffle in its tubular inlet.

* * * * *